US008378915B2

(12) United States Patent
Arvidsson et al.

(10) Patent No.: US 8,378,915 B2
(45) Date of Patent: Feb. 19, 2013

(54) ANTENNA ASSEMBLY

(75) Inventors: Per-Anders Arvidsson, Solna (SE); Mario Arias, Vallentuna (SE); Michael Beausang, Bergsharma (SE); Jesper Uddin, Stockholm (SE); Annika Hu, Akersberga (SE)

(73) Assignee: Powerwave Technologies Sweden AB, Kista (SE)

( * ) Notice: Subject to any disclaimer, the term of this patent is extended or adjusted under 35 U.S.C. 154(b) by 238 days.

(21) Appl. No.: 12/759,582

(22) Filed: Apr. 13, 2010

(65) Prior Publication Data

US 2010/0265150 A1 Oct. 21, 2010

Related U.S. Application Data

(60) Provisional application No. 61/170,204, filed on Apr. 17, 2009.

(30) Foreign Application Priority Data

Apr. 17, 2009 (SE) ..... 0900515

(51) Int. Cl.
*H01Q 21/00* (2006.01)

(52) U.S. Cl. ..... 343/836; 343/837; 343/912

(58) Field of Classification Search ..... 343/836, 343/837, 838, 912

See application file for complete search history.

(56) References Cited

U.S. PATENT DOCUMENTS

| | | | | |
|---|---|---|---|---|
| 4,518,969 | A * | 5/1985 | Bogner | 343/819 |
| 5,872,544 | A * | 2/1999 | Schay | 343/727 |
| 6,034,649 | A | 3/2000 | Wilson et al. | |
| 6,040,802 | A * | 3/2000 | Smith et al. | 343/700 MS |
| 6,995,724 | B2 | 2/2006 | Teshirogi et al. | |
| 7,023,398 | B2 | 4/2006 | Gottl et al. | |
| 7,573,434 | B2 * | 8/2009 | Le Bayon et al. | 343/797 |
| 7,868,843 | B2 * | 1/2011 | Borau et al. | 343/844 |
| 2010/0013729 | A1 * | 1/2010 | Harel et al. | 343/837 |

OTHER PUBLICATIONS

PCT International Search Report pertaining to Swedish Patent Application No. 0900515-8 mailed Oct. 8, 2009.

* cited by examiner

*Primary Examiner* — Tho G Phan
(74) *Attorney, Agent, or Firm* — OC Patent Law Group

(57) ABSTRACT

An antenna assembly and a method of mounting such an assembly are disclosed. A first and a second assembly portion are joined together, wherein the assembly portions each comprise a elongated reflector body serving as a reflector for electromagnetic power radiated by the antenna assembly portion, and a set of antenna element receiving means located in a linear row along a longitudinal direction of the reflector body for respectively receiving an antenna element, and side portions along the long sides of the said reflector body. The assembly method comprises the step of fastening the first and second assembly portions to each other along a respective side portion of the said assembly portions so as to form a dual array antenna assembly.

15 Claims, 4 Drawing Sheets

ANTENNA ASSEMBLY

RELATED APPLICATION INFORMATION

The present application claims priority under 35 U.S.C. Section 119(e) to U.S. provisional patent application No. 61/170,204 filed on Apr. 17, 2009, the disclosure of which is incorporated herein by reference in its entirety.

FIELD OF THE INVENTION

The present invention relates to antenna assemblies and methods of manufacturing such assemblies.

BACKGROUND OF THE INVENTION

The use of cellular telephone systems is constantly increasing, which, in turn, imposes increasing demands on the coverage and capacity of the cellular telephone systems.

Cellular telephone system coverage and capacity, however, is largely dependent on the antennas being used, and the locations of the antennas, which ultimately has an impact on the number of antennas/antenna sites that are required to provide the desired network coverage and capacity.

A conventional cell site often has a number of physical units. Firstly, the site comprises the actual antenna, which often, in order to allow control of the antenna lobe radiated by the antenna, consists of an array of antenna elements, which renders the antenna rather space requiring, in particular in the longitudinal direction of the antenna. Apart from the antenna, there are remote electrical tilt (RET) units, which are used to control the general direction of the lobe radiated by the antenna, amplifiers etc.

These units all require physical space and also often interconnection by means of cables. Further, a cell site often comprises a plurality of antennas, each of which requiring its associated equipment. This makes cell site planning a challenge from an aesthetic point of view, and often gives rise to conflicts with environmentalists and owners of buildings and other locations at which the cell sites are to be located. With regard to cell sites comprising masts, these masts are often of a framework kind, with little possibilities of hiding the antenna equipment.

The constantly increasing demands with regard to communication capacity will also result in more and more cell sites, thus rendering it even more difficult to position the antenna equipment at less visible and thereby aesthetically less disturbing locations.

Consequently, there exists a need for providing "cleaner sites". One such approach is an approach, in which all the equipment and cables associated with an antenna array is integrated into a single unit. This integration not only improves the aesthetics of a cell site, but can also result in better performance, leading to a more reliable system operation.

However, such integration attempts can also give rise to other more negative effects, e.g. with regard to the manufacturing process. Consequently, there exists a need for an improved method of manufacturing antenna assemblies.

SUMMARY OF THE INVENTION

It is an object of the present invention to provide a manufacturing method for manufacturing antenna assemblies comprising a plurality of antenna arrays that at least mitigates the above mentioned problems.

It is another object of the present invention to provide a device resulting from the manufacturing process.

According to a first aspect of the present invention, it is provided a method for manufacturing an antenna assembly, the method comprising the step of assembling a first assembly portion and a second assembly portion, the first assembly portion comprising a first elongated reflector body serving as a reflector for electromagnetic power radiated by the first antenna assembly portion, a first set of antenna elements receiving means located in a linear row along a first longitudinal direction of the reflector body for respectively receiving an antenna element, and side portions along the sides in the longitudinal direction of the reflector body.

The second assembly portion comprises a second elongated reflector body serving as a reflector for electromagnetic power radiated by the second assembly portion, and a second set of antenna element receiving means located in a linear row along a second longitudinal direction of the second reflector body for respectively receiving an antenna element, the second longitudinal direction being at least substantially parallel to the first longitudinal direction and side portions along the long sides of the second reflector body. The first and second assembly portions are fastened to each other along a respective side portion of the first and second assembly portions so as to form a dual array antenna assembly.

This has the advantage that torsional rigidity of the antenna assembly can be substantially improved as compared to prior art solutions, since the additional center wall formed by the side portions of the assembly portions will have a substantial effect on the torsional rigidity in a positive manner. Further, the invention also has the advantage that the number of antenna assembly variants that has to be manufactured can be kept to a minimum.

There are many practical embodiments of the antenna assembly according to the invention, as will be apparent from the detailed description below. Thus, the invention will now be explained in more detail with reference to the appended drawings illustrating an exemplary embodiment.

DETAILED DESCRIPTION OF EXEMPLARY EMBODIMENTS

The demand for antennas for mobile wireless applications has increased dramatically, and today there exist a number of various radio access technologies for providing wireless communication. A wide range of frequency bands has been allocated, and is being used, for the various existing kinds of wireless communication, and for providing communication in a plurality of frequency bands, also within one single radio access technology.

When older wireless communication systems are being replaced in favour of newer technology, the frequency resources of the older system are in general reused, since the increasing demands on wireless communication makes efficient utilization of existing frequency bands increasingly important.

Even so, it is also common that two or more radio access technologies co-exist and utilize at least partially overlapping frequency bands, e.g. older and newer generation radio access technologies, or radio access technologies being intended for different kinds of services, with the result that a single antenna site may comprise similar antenna assemblies that transmit the same, or partially overlapping, frequency bands although using different radio access technologies.

The increasing use of co-existing radio access networks, and radio access networks utilizing overlapping frequency bands, also imposes further difficulties in the providing of antenna sites that are favourable from an aesthetics point of view, since the number of units at the antenna sites is increased by additional antenna assemblies (and associated equipment) radiating in substantially the same direction and in substantially the same frequency bands.

In an effort to reduce such visual impact on the environment, and also to reduce the amount of space required to provide desired coverage/capacity, there exists a desire to include more than one antenna array within a single protective cover (radome), and, in particular, to accomplish this in a cost-efficient manner, e.g. from a manufacturing point of view. This problem is addressed, and at least mitigated, by the present invention, which provides for a simple method of manufacturing antenna assemblies, for example, but not limited to, antenna assemblies wherein service is provided by two or more arrays having the same, or substantially the same frequency bands.

Figure 1:
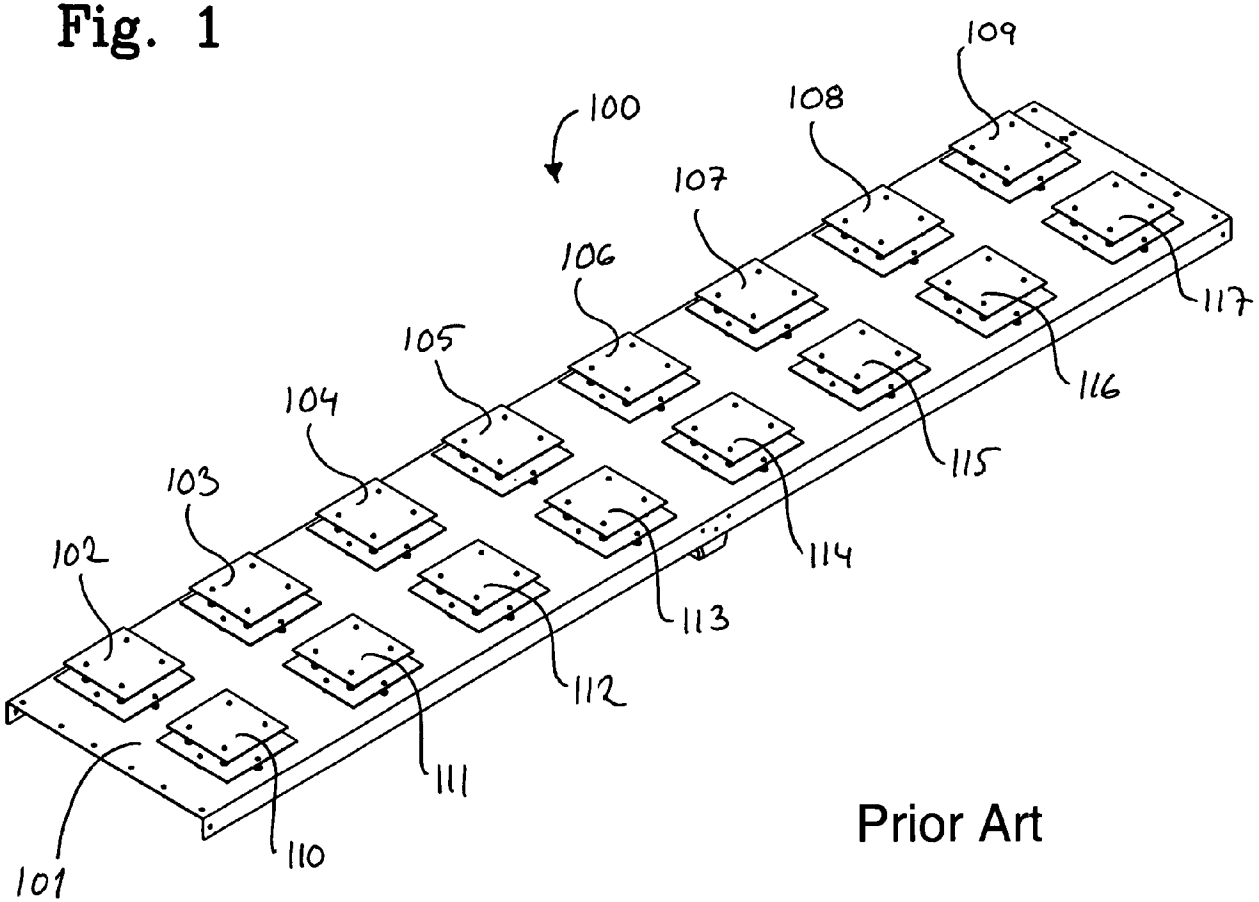
Fig. 1 Prior Art
FIG. 1 illustrates schematically, in a perspective view, an antenna assembly according to the prior art.

A straight-forward solution to achieving the above is to arrange two (or more) parallel arrays on a common reflector body, enclosed by a single radome. An example of such a solution is disclosed in FIG. 1. The antenna assembly 100 of FIG. 1 comprises two arrays of antenna elements arranged on a common reflector body 101. Each array comprises radiating antenna elements 102-109 and 110-117, respectively. This solution, however, is subject to various drawbacks.

One inherent problem with antenna assemblies is that they in general require a "ground plane", i.e. an essentially flat conductive surface. Ideally it should be big, large ground planes give better performance but of course make the antenna bigger, while a smaller surface will gradually decrease the performance of the antenna.

Firstly, the reflector body 101, which in general consists of a rigid metal sheet and which essentially is the element providing torsional rigidity of the antenna assembly, is relatively thin, and the increased width of the antenna assembly will give rise to problems with respect to the torsional rigidity of the structure. The problem becomes even more severe when more than two arrays are to be arranged adjacent to each other enclosed by a common radome, since the wider the reflector plate is, the lesser is the torsional rigidity.

Further, the antenna elements often consist of patch assemblies with associated radiating apertures, wherein the apertures are formed in the rigid metal sheet (reflector body), e.g. by a punching process, which gives rise to further problems with mechanical tolerances, e.g. since, with respect to arrays consisting of plural antenna elements, the size of the metal sheet constituting the reflector can be considerable, with the result that the antenna assembly gives rise to a weak design.

Such kinds of assemblies, therefore, give rise to manufacturing side effects, since the torsional rigidity can not easily be increased without adversely affecting the ground plane. Therefore, in order to strengthen the torsional rigidity, the thickness of the reflector/ground plane often must be increased, with increased cost and weight as result.

According to the present invention, this problem is overcome, or at least mitigated by a manufacturing method wherein a first array antenna assembly is manufactured in a conventional manner, apart from radome and gable portions, and wherein a second array of the dual array antenna assembly, e.g. identical to the first array, is manufactured in a similar manner, wherein the two "single array" antenna assemblies then are joined together so as to form a dual array antenna assembly.

The invention will be exemplified more in detail in the following with reference to a single array antenna assembly of conventional design. Such antenna arrays are known per se, and will therefore be relatively briefly discussed.

Figure 2A:
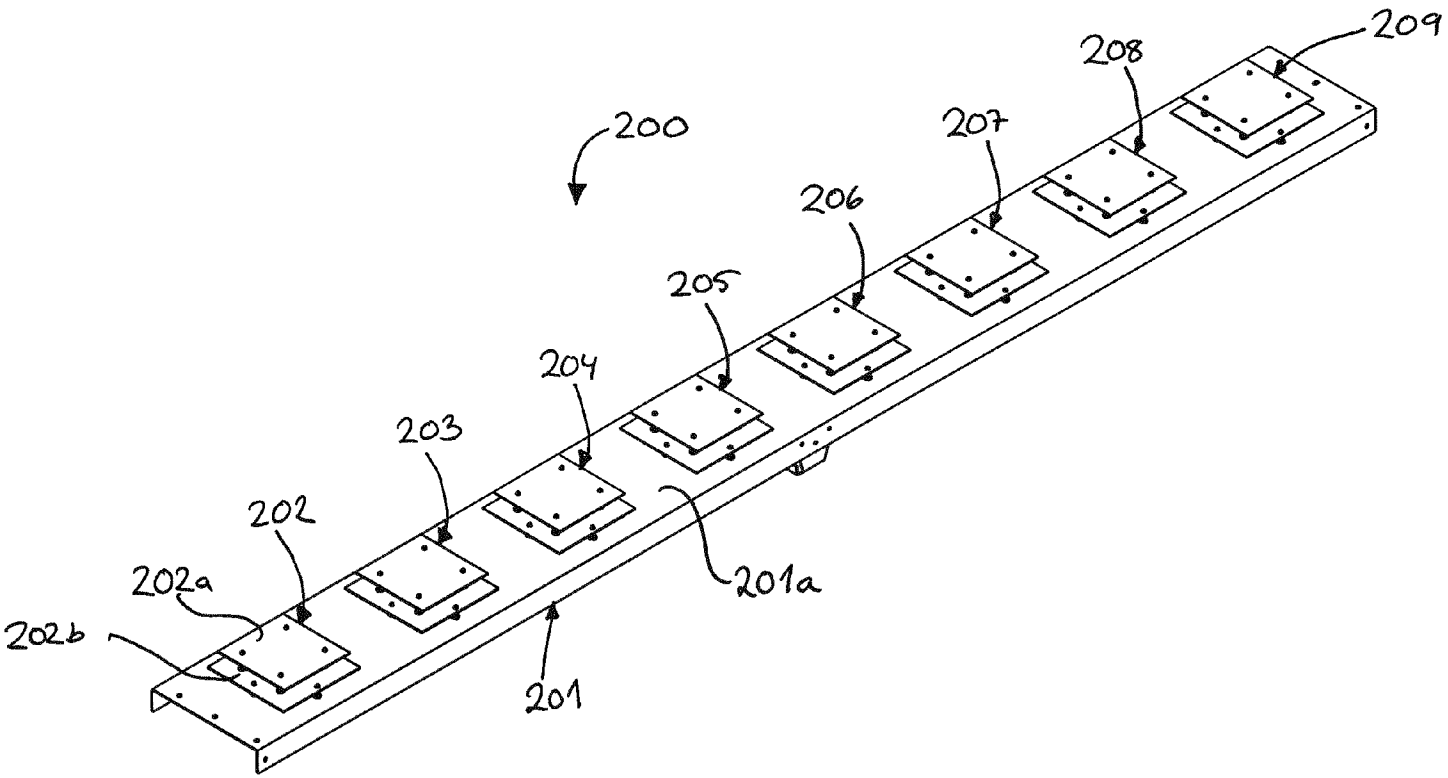
FIG. 2*a* illustrates schematically a typical array antenna assembly of aperture type.
Figure 2B:
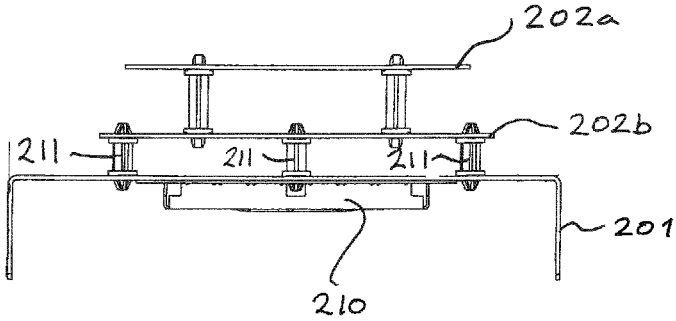
FIG. 2*b* illustrates a cross-sectional appearance of the antenna assembly of FIG. 2*a;*

A typical aperture coupled patch antenna comprises a dielectric laminate, for example a PCB (Printed Circuit Board), wherein a feeding network, including an aperture feed feeding the antenna elements, is provided on one side of said PCB, typically by means of etching. The laminate is further, and in general, provided with an electrically conductive layer on the opposite side serving as a ground plane for the aperture feed. The PCB (ground plane layer) is (electrically) secured to a reflector body consisting of a rigid metal sheet having a substantially planar portion to which the antenna elements are fastened. An exemplary antenna assembly according to the above is shown in FIGS. 2*a-b*, although feed network and PCB can not be seen from the figures. Reference numeral 200 generally designates the antenna assembly. A typical array antenna assembly of aperture type is shown in FIG. 2*a* and comprises a plurality of antenna elements 202-209 arranged as a linear row of antenna elements, the antenna assembly 200 thereby being elongated in a longitudinal direction.

The radiating elements 202-209 consist of patch antenna elements, and are operable to transmit and/or receive RF signals, i.e. any alternative thereof, e.g. at a base station in a cellular mobile telephone system, and are arranged on the front side of a reflector body 201 on a substantially planar portion 201*a* of the reflector body 201 in a manner known per se. The reflector body 201 serves as a reflector for directing electromagnetic power radiated by the antenna elements 202-209. The antenna elements 202-209 comprises aperture coupled, planar, patch assemblies consisting of electrically conducting patches, e.g. 202*a*, 202*b*, being placed at a distance from the reflector body 201, e.g. by means of distance elements 211, and centered in relation to a central point of a (e.g. cross-shaped) aperture (not shown) in the reflector body in a manner known per se. The antenna elements can, e.g., consist of single band, dual band or triple band elements in a manner also known per se, and the various frequency bands can be spaced apart or overlapping. In the disclosed embodiment, the two patches 202*a*, 202*b* are used for transmission in two relatively similar frequency bands.

The reflector body 201 consists of a rigid metal sheet, which is made from an electrically conductive material. The general cross-sectional appearance of the reflector body can, in principle have any desired shape, the side portions of which in general being designed in a manner favorable to desired radiation properties of the antenna. An example of the cross-sectional appearance of the reflector body 201 is indicated in FIG. 2*a* and shown more in detail in FIG. 2*b*. As can be seen from FIG. 2*b*, the cross-sectional appearance of the exemplary reflector body is relatively uncomplicated, i.e. being U-shaped. The reflector 201 further comprises apertures (not shown) associated with each radiating patch, wherein aperture feeds are provided by the PCB on the backside of the reflector body 201. The figure further shows the antenna element 202 with patches 202*a*, 202*b*. The figure also shows distance elements 211 by means of which the antenna element 202 is attached to the reflector body 201, via antenna element receiving means, such as, e.g. receiving holes in the reflector body 201 for e.g. snap-fitting of the distance elements 211.

Figure 3B:
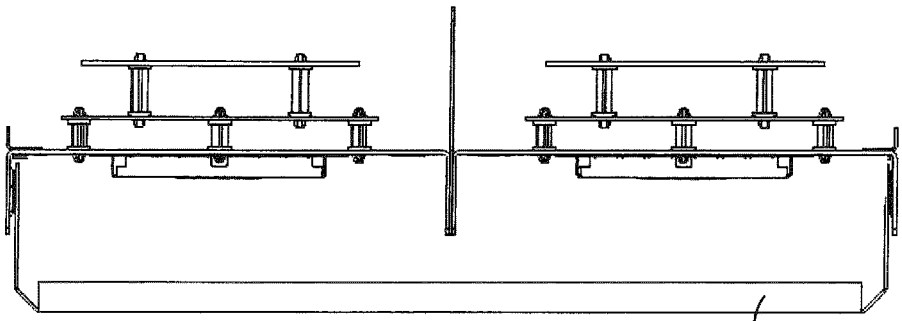
FIG. 3*b* illustrates a cross-sectional appearance of the antenna assembly of FIG. 3*a;*
Figure 3C:
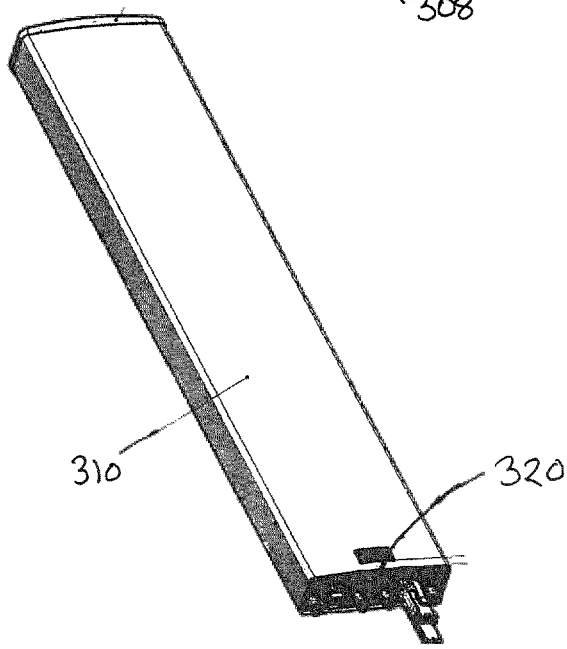
FIG. 3*c* illustrates the antenna assembly of FIG. 3*a* provided with protective cover.

Signals to be transmitted by the antenna array are supplied to the aperture feeds by means of a feed network which connects an input terminal, often located on an antenna gable at the lower end of the antenna (the general appearance of an antenna gable is schematically indicated as 320 in FIG. 3*c*) to the various antenna elements. As mentioned, each aperture is associated with a patch assembly and serve as a radiating element in order to couple high frequency electromagnetic power between the feed network and the radiating patch elements. Often, the antenna assembly also comprises a phase shifting means (not shown), so as to allow adjustment of the general lobe angle of the main lobe radiated by the antenna. In order to prevent backward radiation and the propagation of electromagnetic radiation in the longitudinal direction on the rear side of the reflector, shielding boxes of a metal material can be secured in a manner known per se behind each radiating aperture (indicated by 210 in FIG. 2*b*).

A manufacturing facility can be required to produce a large number of antenna assembly variants, for example, even single-array antenna assemblies are manufactured in many variants, e.g. as single band arrays for various different frequencies, dual, triple band columns etc., and for dual array (or more) assemblies the number grows even further.

According to the present invention, antenna assembly manufacturing is facilitated to a large extent since multi-array antenna assemblies are obtained using a manufacturing method wherein the antenna arrays are assembled as single-array assemblies, followed by the two (or more) single-array assemblies being fastened together into a multi-array assembly. This has the advantage that, in principle, only protective housing (radome) and, if used, gables, has to be provided for the assembly, since all other parts remain the same as for the single-array version. Furthermore, the radome can, for example, be made from a dielectric material, such as, e.g., a thermoplastic material.

This has the advantage that the number of variants that has to be manufactured can be kept to a minimum.

Figure 3A:
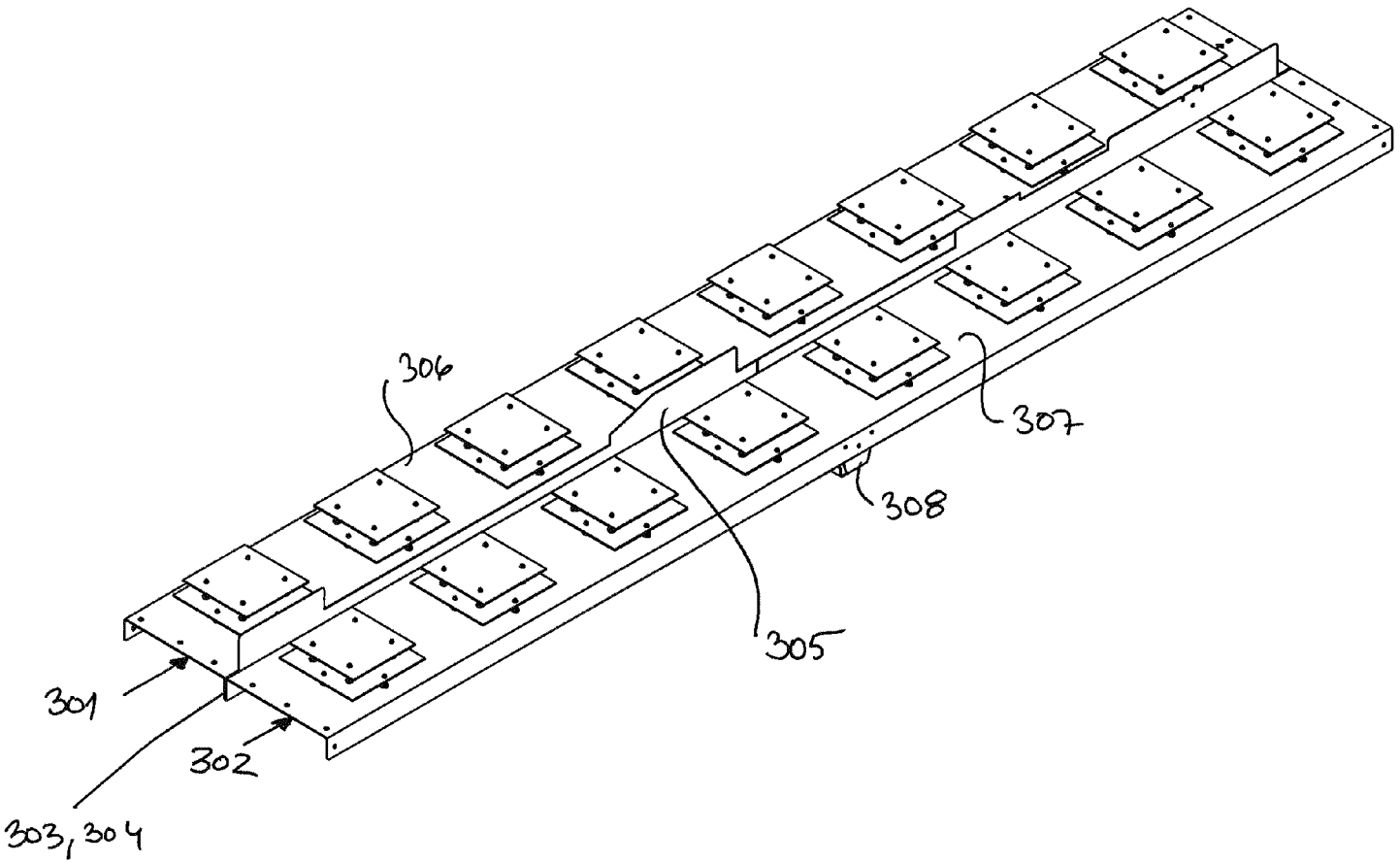
FIG. 3*a* illustrates an exemplary embodiment of an antenna assembly according to the present invention.

An exemplary embodiment of an antenna assembly according to the present invention is disclosed in FIG. 3*a-c*, which, in principle, shows two antenna assembly portions 301, 302 of the kind shown in FIG. 2*a* and being fastened to each other along a respective side portion 303, 304 of the said antenna assemblies 301, 302. Conventionally, the reflector body often consists of a metal sheet wherein the said side portions are produced by bending the said metal sheet to side portions of a desired shape, e.g. in order to improve radiation properties according to the above. If the reflector bodies define the side portions 303, 304 (see also FIG. 3*b*), the reflector bodies 306, 307 are preferably designed in a manner that is suitable both for being enclosed by a radome in the single array embodiment, e.g. U-shaped as in the disclosed example, although other designs are, of course, possible, and for being fastened to each other according to the present invention. The side portions can, of course, also consist of separate elements being joined together with the reflector bodies. The antenna assembly portions can, for example, be securely fastened to each other by means of mechanical fasteners, preferably in a non-conductive manner as will be explained below.

An example of the cross-sectional appearance of the assembly according to the present invention is shown more in detail in FIG. 3*b*. Apart from isolation layer 305 and the parts shown in FIG. 2*b*, the figure further discloses a support 308, which can be used to increase rigidity of the structure.

FIG. 3*c* illustrates the antenna assembly of FIG. 3*a* provided with protective cover 310 and gable 320 comprising connections in a conventional manner.

In one embodiment and adhesive, such as an adhesive tape having an adhesive layer on both sides thereof is applied onto one or both side portions being joined together, so as to further strengthen the bond.

The assembly portions being joined together can be arranged for receiving and/or transmitting electro-magnetic signals in the same frequency band (or bands), e.g. to provide service, for example using different radio access technologies, in the same or partially overlapping frequency band(s). Use of two (or preferably more) identical assembly portions can also be used to provide control of the azimuth angle of the radiated antenna lobe.

Further, instead of joining together assembly portions where antenna elements, PCBs etc. already has been assembled, it can be to prefer to first join together the reflector bodies and thereafter fit antenna elements, PCBs etc. In this solution, the reflector bodies are ready in as much that mounting holes and such are already present, e.g. apertures which often are obtained by a punching process and antenna element receiving means, such as, e.g. holes at the intended antenna element locations for receiving distance elements for fastening of patches.

According to the present invention the torsional rigidity is substantially improved, since the additional center wall formed by the side portions of the assembly portions will have a substantial effect on the torsional rigidity in a positive manner. A satisfactory torsional rigidity is essential to proper operation of the antenna assembly, since it is essential that the reflector body is secured in a well-defined position in relation to the ground plane layer and/or feed network and/or antenna patches, so that a good electrical coupling is achieved, e.g. in the form of a capacitive coupling. It is also important to establish a well-defined mechanical bond, so that the radiation parameters are obtained as desired and according to what has been calculated in advance. The invention also has the advantage that less rigid protective covers can be used, for example, protective covers without glass-fibre reinforcement can be used, which reduces cost and weight of the antenna assembly.

The above embodiment of the present invention can be further improved by imposing an isolating layer 305 between the assembly portions so as to ensure that the assembly portions can be fastened to each other in a non-conducting manner. If the antenna arrays are connected to each other in a non-conductive manner, intermodulation, between the antenna arrays, which otherwise can arise, can be kept to a minimum. In this embodiment, adhesive, such as an adhesive tape, can be applied onto both side portions and both sides of the isolation layer.

Apart from assembling identical or substantially identical antenna arrays according to the above, it is also contemplated that the assembly portions being fastened to each other can be arranged to radiate microwave power in completely different frequency bands, in which case the present invention can be utilized to clean up antenna sites by housing plural antenna arrays in a single radome. In this embodiment, the lengths of the respective antenna arrays should preferably be the same or substantially the same so as to facilitate design of, e.g., protective cover (radome).

So far, the present invention has been described in the context of patch antenna assemblies in general, and the present invention is applicable in the manufacturing of antenna assemblies comprising various kinds of antenna elements, e.g. single-band, dual-band or multi-band antennas.

In principle, the present invention is applicable for manufacture of antenna assemblies utilizing practically any kind of elements that are suitable for wireless communication. For example, the antenna elements can consist of any one from the group consisting of: aperture antennas, such as slots, horns or aperture coupled patch antennas, dipole antennas or probe fed antennas.

What is claimed is:

1. A method for manufacturing an antenna assembly, the method comprising the step of assembling a first and a second assembly portion, the first assembly portion comprising:

a first elongated reflector body serving as a reflector for electromagnetic power radiated by the first antenna assembly portion, a first set of antenna element receiving means located in a linear row along a first longitudinal direction of said reflector body, for respectively receiving an antenna element, and side portions along the long sides of said reflector body, wherein said second assembly portion comprises:

a second elongated reflector body serving as a reflector for electromagnetic power radiated by said second assembly portion, and a second set of antenna element receiving means located in a linear row along a second longitudinal direction of said second reflector body for respectively receiving an antenna element, said second longitudinal direction being at least substantially parallel to said first longitudinal direction, and side portions along the long sides of said second reflector body, the method comprising fastening said first and second assembly portions to each other along a respective adjacent side portion of said first and second assembly portions so as to form a dual array antenna assembly.

2. A method according to claim 1, wherein the reflector bodies each have a substantially planar portion upon which the said antenna elements are arranged.

3. A method according to claim 1, wherein the reflector bodies are comprised of a metal sheet, and wherein said side portions are produced by bending the metal sheet by one or more longitudinal bends into side portions of a desired shape.

4. A method according to claim 1, wherein each of said assembly portions is arranged for receiving and/or transmitting signals in at least one frequency band, respectively, said two frequency bands being at least partially overlapping.

5. A method according to claim 1, wherein an isolation layer is imposed between the said assembly parts side portions so as to ensure that the assembly parts are fastened to each other in a non-conducting manner.

6. A method according to claim 1, wherein said antenna assembly portions are securely fastened to each other by means of mechanical fasteners.

7. A method according to claim 1, wherein more than two assembly portions are being fastened to each other so as to form a multi-array antenna assembly.

8. A method according to claim 1, further including the step of fitting antenna elements to said antenna element receiving means prior to or after fastening said first assembly portion to the said second assembly portion.

9. A method according to claim 1, wherein each of said first and second reflector bodies further comprises at least one antenna aperture associated with each antenna element receiving means.

10. A method according to claim 1, wherein said first reflector body and the second reflector body are substantially identical.

11. A method according to claim 1, further comprising the step of enclosing the said antenna assembly portions by a common protective housing.

12. An antenna assembly that has been manufactured according to the method of claim 1.

13. An antenna assembly, comprising:

a first assembly portion comprising:

a first elongated reflector body serving as a reflector for electromagnetic power radiated by the first antenna assembly portion, a first set of antenna element receiving means located in a linear row along a first longitudinal direction of said reflector body, for respectively receiving an antenna element, and side portions along the long sides of said reflector body;

a second assembly portion comprising:

a second elongated reflector body serving as a reflector for electromagnetic power radiated by said second assembly portion, and a second set of antenna element receiving means located in a linear row along a second longitudinal direction of said second reflector body for respectively receiving an antenna element, said second longitudinal direction being at least substantially parallel to said first longitudinal direction, and side portions along the long sides of said second reflector body; and means for fastening said first and second assembly portions to each other along a respective adjacent side portion of said first and second assembly portions so as to form a dual array antenna assembly.

14. An antenna assembly according to claim 13, wherein said means for fastening comprises a mechanical fastener.

15. An antenna assembly as set out in claim 13, further comprising an isolation layer configured between the side portions of said first and second assembly portions.

* * * * *